United States Patent [19]

Westervelt et al.

[11] 4,011,832

[45] Mar. 15, 1977

[54] BUILD CONTROL FOR FLUIDIZED BED WIRE COATING

[75] Inventors: Dean C. Westervelt, Acme, Pa.; Robert E. Pierce, Abingdon, Va.

[73] Assignee: Westinghouse Electric Corporation, Pittsburgh, Pa.

[22] Filed: Feb. 26, 1975

[21] Appl. No.: 553,201

[52] U.S. Cl. ..... 118/301; 118/309; 118/634; 427/282; 118/DIG. 5

[51] Int. Cl.[2] ..... B05C 11/16

[58] Field of Search ..... 118/301, 309, 406, 420, 118/624, 629, DIG. 5, DIG. 19, DIG. 20, 634, 404, 405; 427/117, 185, 189, 195, 282, 286

[56] References Cited

UNITED STATES PATENTS

| | | | |
|---|---|---|---|
| 1,187,008 | 6/1916 | Nehring | 118/DIG. 19 |
| 1,952,502 | 3/1934 | Kinkead | 118/309 |
| 1,961,667 | 6/1934 | Johnson | 427/117 |
| 2,789,926 | 4/1957 | Finholt et al. | 427/195 |
| 3,352,285 | 11/1967 | Buhmann | 118/624 |
| 3,396,699 | 8/1968 | Beebe et al. | 118/634 |
| 3,566,833 | 3/1971 | Beebe et al. | 118/634 |
| 3,669,738 | 6/1972 | Cottis et al. | 427/195 |
| 3,695,909 | 10/1972 | Fabre et al. | 118/624 |
| 3,828,729 | 8/1974 | Goodridge | 118/634 |

*Primary Examiner*—Mervin Stein
*Assistant Examiner*—Douglas Salser
*Attorney, Agent, or Firm*—R. D. Fuerle

[57] ABSTRACT

A build control is disclosed, for controlling the thickness of a coating on different sides of an elongated member such as a wire. The build control is a tube which is positioned around the wire as the wire passes through a fluidized powder. The end of the tube which is in the fluidized powder is notched so that the build of powder on each of the sides of the elongated member is more or less than would otherwise result.

15 Claims, 4 Drawing Figures

FIG.2
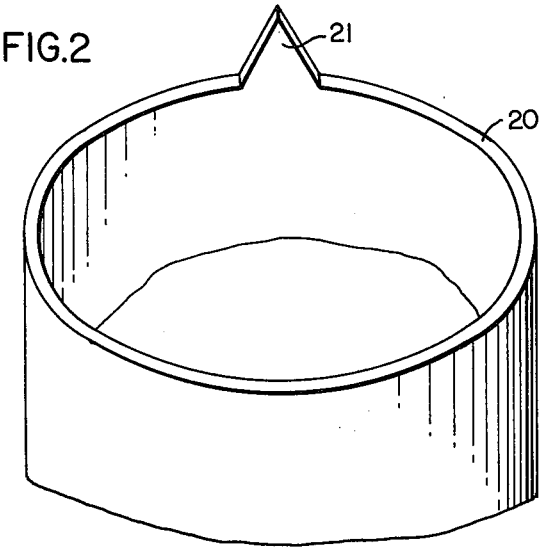
FIG.3
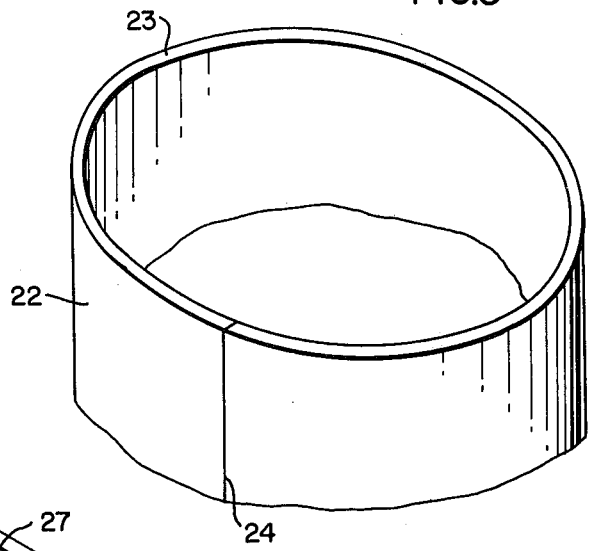
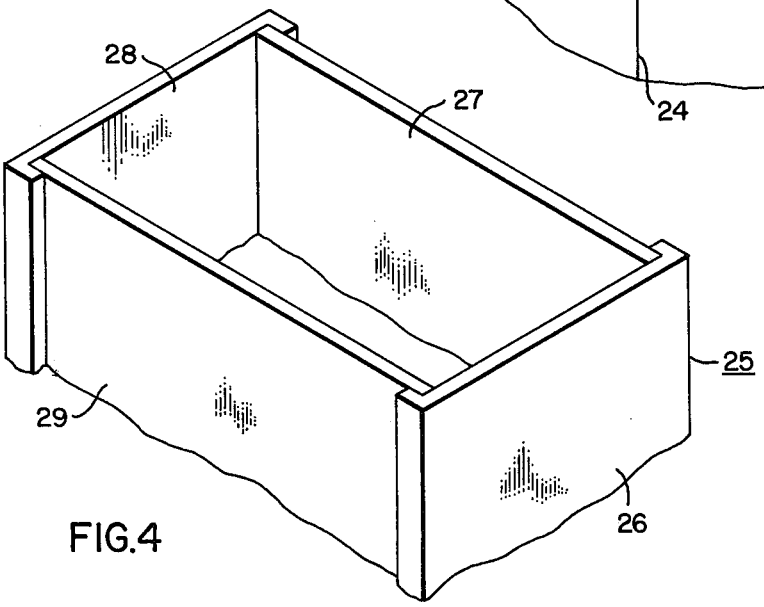
FIG.4

BUILD CONTROL FOR FLUIDIZED BED WIRE COATING

BACKGROUND OF THE INVENTION

Wire and other elongated members can be coated by passing them through a fluidized powder. If the wire is heated the powder melts on contact and forms a coating. If the powder is charged and the wire is grounded, the powder clings to the wire until the wire passes through an oven where the powder melts and coats the wire.

The thickness or build of the coating on one side of the wire may be more or less than the thickness on the rest of the wire. This may be due to the uneven movement of the powder in the bed, or in an electrostatic bed to a non-uniform electrostatic field around the wire due to the presence of interfering objects. Often the cause of the non-uniformity of the coating cannot be readily ascertained.

In any event, a wire which is not coated uniformly may be entirely unusable since a too thin coating may not provide adequate insulation and a too thick coating may mean that the wire will not fit, in addition to wasting powder.

PRIOR ART

U.S. Pat. No. 3,566,833 discloses coating a wire in an electrostatic fluidized bed. Tubes are used to control the build on the wire.

SUMMARY OF THE INVENTION

We have discovered that the build thickness of a powder coating applied from a fluidized powder on different sides of a wire or other elongated member can be controlled by partially shielding the wire from the powder with a tube which is notched at its end. The width and position of the notch determines the area of build and the depth of the notch determines the amount of build.

DESCRIPTION OF THE INVENTION

FIGS. 2 and 3 are isometric end views of various tubes according to this invention.

FIG. 4 is an isometric end view of a rectangular, four-sectional tube according to this invention.

Figure 1:
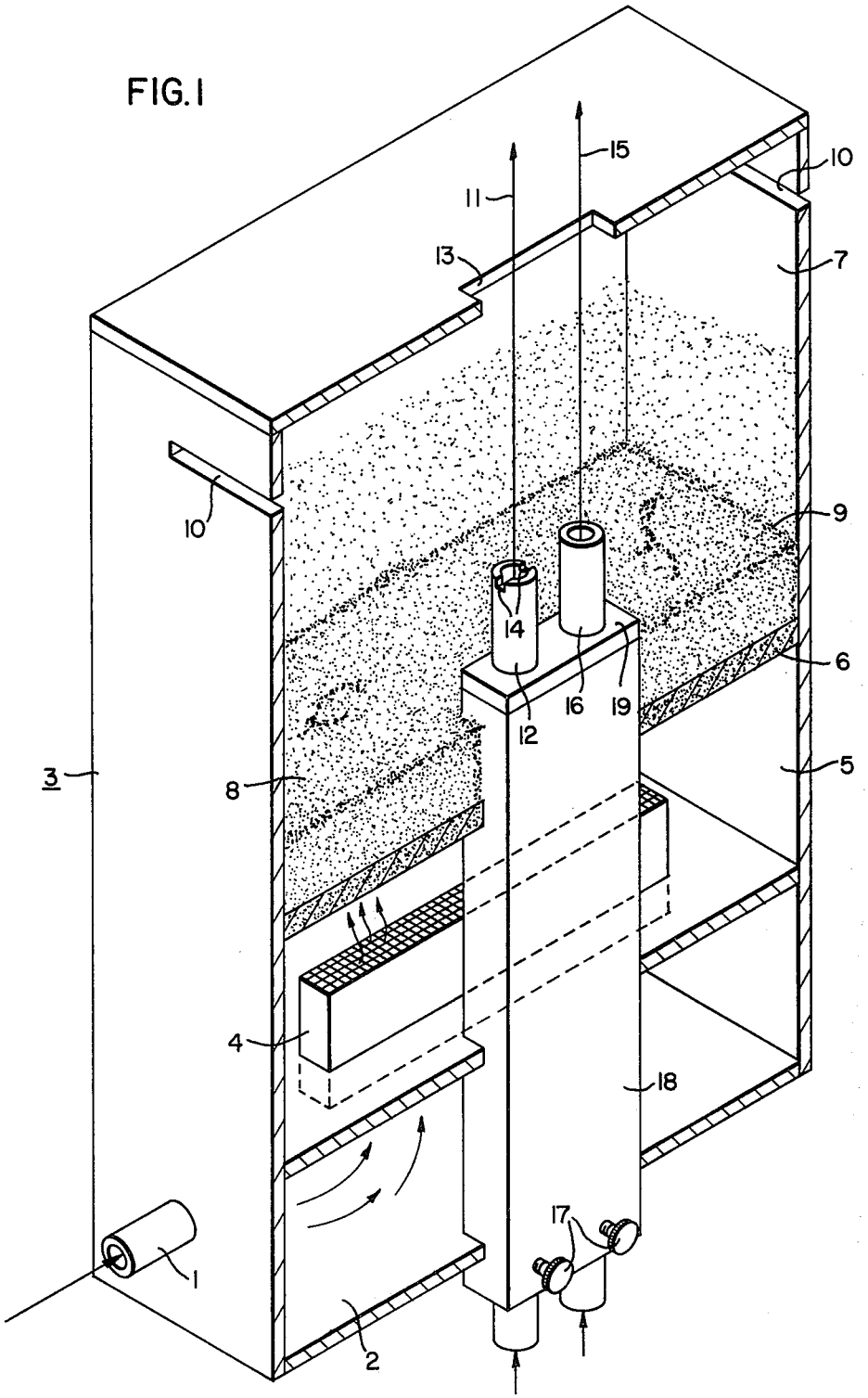
FIG. 1 is an isometric cross-sectional view of an electrostatic fluidized bed coating apparatus utilizing a tube according to this invention.

In FIG. 1 air from entry port 1 enters lower chamber 2 of coating apparatus 3. The air passes through charging chamber 4 where it is given an electrostatic charge. The charged air then passes from middle chamber 5 through diffuser plate 6 into upper chamber 7 where it charges powder 8 and fluidizes the powder to level 9. The air then passes out exhaust slots 10 to filters (not shown). A grounded wire 11 passes through circular tube 12, upper chamber 7, wire exit slot 13, and thence through an oven (not shown). The top end of the tube has two notches 14 on the sides. This particular tube could be used if the build on the two sides of the wire facing the notches was less than the build on the other two sides and an equal build was desired. A second wire 15 passes through circular tube 16, upper chamber 7, wire exit slot 13, and the oven (not shown). Each tube can be independently raised or lowered to control the overall build on the wires and is held in place by set screws 17 in wire entry box 18. Both tubes are held in position by cover 19 which can be exchanged for covers with one, three, or another number of holes in it, or with rectangular or other shaped holes, should it be necessary to change the number of wires coated or the shape of the tubes. In a vertical electrostatic fluidized bed, the lowest point at the top end of the tubes should be above the fluidized level 9 of the powder, and preferably about ½ to about 3 inches above that level so that instabilities in the fluidized level do not cause the powder to flow down the tube. A cloud of powder particles forms above the fluidized level and it is this cloud which coats the wire. Hereinafter, the term "aerated powder" is used to include both fluidized powder and a cloud of powder.

FIG. 2 shows a circular tube 20 which is widely notched leaving only V-shaped peak 21. This tube could be used to remove a streak of heavy build on one side of the wire when an equal build is desired.

FIG. 3 shows a circular tube 22, the end 37 of which has been cut at an angle. This tube could be used if the build on the wire gradually changed from too much on one side to too little on the other and an equal build was desired. This tube is made of a flexible material and is split at 24 so that it can be pried open and placed over the wire, which avoids cutting the wire in order to place the tube around it.

In FIG. 4, a rectangular tube 25 is composed of four sides 26, 27, 28 and 29 each of which can be moved up or down (axially) independently of the other sides. This tube is particularly useful for wires which move horizontally through the bed. In such cases the build on the bottom of the wire often exceeds the build on the top of the wire. The lower side of the tube would then be extended into the bed until the build on all sides was equal.

It should be mentioned that it may in some instances be desirable to have a heavier build on one side of the wire as, for example, when that side is subjected to greater electrical stress. It may also be desirable in certain instances to have less insulation or no insulation on one or more sides of the wire, for example, when the electrical stress is less or when electrical contact must be made. The tubes of this invention are equally useful in such cases.

Preferably, the geometry of the inside of a cross-section through the tube is congruent with the geometry of the outside of a cross-section through the wire. This is an advantage in making the coating uniform, since the wire is the same distance on all sides from the tube. The distance between the tube and the wire is preferably about 1/16 to about ¼ inch to allow sufficient clearance yet minimize the amount of powder which falls down the tube.

As the drawings indicate, the "notch" in the end of the tube can take many different forms. It is only required that at least a portion of the end of the tube be cut at an angle other than 90° to the axis of the tube. That is, a portion of the end of the tube is cut at an angle of 0° to 89° to the tube axis, and preferably of 0 to 60° since larger angles have less effect. Non-linear (i.e, curved) cuts are also contemplated. Broadly speaking, the concept of this invention embodies any barrier which at least partially shields only a portion of the outside cross-sectional perimeter of the wire or other elongated member from the fluidized powder or powder cloud.

It should be understood that although this invention is primarily concerned with wire, including round wire, square wire, and rectangular wire, the teachings herein are applicable to any elongated member including pipes, tubes, and rods. Also, while the description herein has been of a electrostatic fluid bed, the invention is equally applicable to ordinary fluidized beds, to electrostatic spray gun coating, and the like, any of which may be in a vertical or horizontal position.

We claim as our invention:

1. In an apparatus for coating an elongated member with an aerated powder by passing said elongated member through said aerated powder, build control means for controlling the build of said powder on said elongated member, said build control means comprising a barrier which at least partially shields only a portion of an outside cross-sectional perimeter of said elongated member from said aerated powder.

2. Build control means according to claim 1 wherein said aerated powder is electrostatically charged and said elongated member is grounded.

3. Build control means according to claim 2 wherein said elongated member moves vertically through said powder.

4. Build control means according to claim 3 wherein said barrier is a tube through which said elongated member passes, said aerated powder is at least partially fluidized, and the lowest point on said end of said tube is above the top of said fluidized powder.

5. Build control means according to claim 4 wherein said lowest point is about ½ to about 3 inches above the top of said fluidized powder.

6. Build control means according to claim 1 wherein said barrier comprises a tube through which said elongated member passes, at least one end of said tube being exposed to said aerated powder, said end being at least in part cut at an angle other than 90° to the axis of said tube.

7. Build control means according to claim 6 wherein said tube has at least one side which is movable in a direction parallel to the tube axis.

8. Build control means according to claim 7 wherein said elongated member moves horizontally through said powder and said movable side is on the bottom.

9. Build control means according to claim 6 wherein the geometry of the inside of the cross-section through said tube is congruent with the geometry of the outside of a cross-section through said elongated member.

10. Build control means according to claim 6 wherein the distance between the inside of said tube and the outside of said elongated member is about 1/16 to about ¼ inch.

11. Build control means according to claim 6 wherein said tube is slitted in an axial direction and is flexible.

12. Build control means according to claim 6 wherein said end is uniformly cut at an angle other than 90° to the axis of said tube.

13. Build control means according to claim 6 wherein said end of said tube has at least two cuts at an angle of about 0° to said tube axis, with a single cut of about 90° joining the ends of said two cuts.

14. Build control means according to claim 1 wherein said elongated member is wire of rectangular cross-section.

15. In an electrostatic fluidized coating apparatus wherein a grounded elongated member moves vertically through a charged cloud of powder, means for controlling the build up of said powder on said elongated member, said means comprising a tube through which said elongated member passes, at least one end of said tube being exposed to said cloud, said end being at least in part at an angle other than 90° to the said elongated member.

* * * * *